US006334373B1

(12) United States Patent
Hsieh

(10) Patent No.: US 6,334,373 B1
(45) Date of Patent: Jan. 1, 2002

(54) RATCHET WRENCH STOP MEMBER POSITIONING ARRANGEMENT

(76) Inventor: Chih-Ching Hsieh, No. 64 Lane 107, Liang Tsun Rd., Fong Yuan City, Taichung Hsien (TW)

( * ) Notice: Subject to any disclaimer, the term of this patent is extended or adjusted under 35 U.S.C. 154(b) by 0 days.

(21) Appl. No.: 09/551,492

(22) Filed: Apr. 18, 2000

(51) Int. Cl.[7] ..... B25B 13/46
(52) U.S. Cl. ..... 81/60; 81/58
(58) Field of Search ..... 81/58, 58.4, 59.1, 81/60, 63.1, 63.2

(56) References Cited

U.S. PATENT DOCUMENTS 810,599 A * 1/1906 Ansorge ..... 81/60
4,308,768 A * 1/1982 Wagner ..... 81/60
4,991,468 A * 2/1991 Lee ..... 81/60
5,230,262 A * 7/1993 Ahlund et al. ..... 81/63.2
5,392,672 A * 2/1995 Larson et al. ..... 81/60
5,636,557 A * 6/1997 Ma ..... 81/60
5,692,420 A * 12/1997 Byers ..... 81/465
5,964,129 A * 10/1999 Shiao ..... 81/63.2

* cited by examiner

*Primary Examiner*—Joseph J. Hail, III
*Assistant Examiner*—David B. Thomas
(74) *Attorney, Agent, or Firm*—Varndell & Varndell, PLLC

(57) ABSTRACT

A ratchet wrench stop member positioning arrangement having a stop member mounted in a transversely extended side hole in the body thereof and forced by a spring member into engagement with peripheral teeth of a ratchet wheel in a box in one end of the body, wherein the longitudinal central axis of the side hole defines with the horizontal line which passes through the center of the box a container angle at about 8~18° so that the angle of action produced between the stop member and the ratchet wheel during the operation of the ratchet wrench is minimized, reducing the formation of inactive componenet of force.

1 Claim, 9 Drawing Sheets

RATCHET WRENCH STOP MEMBER POSITIONING ARRANGEMENT

BACKGROUND AND SUMMARY OF THE INVENTION

The present invention relates to a ratchet wrench, and more particularly to such a ratchet wrench in which the angle of action produced between the stop member and the ratchet wheel is minimized, so that maximum torsional force can be achieved.

A variety of ratchet wrenches have been disclosed, and have appeared on the market. FIGS. 1 and 2 show two different structures of ratchet wrench according to the prior art, in which a stop member is forced into engagement with the ratchet wheel to control the direction of rotation of the ratchet in the box in one end of the wrench body. Because a great contained angle is defined between the ratchet wheel and the stop member, much ineffective component of force is produced during the operation of the ratchet wrench. Further, the cover plate, which holds the ratchet wheel in the box, tends to be damaged or permanently deformed during the operation of the ratchet wrench because it is fastened to the wrench body by screws. FIGS. 3 and 4 show another structure of ratchet wrench according to the prior art. According to this design, the stop member receives a driving force from the ratchet wheel at 90° and 180° respectively, and a great contained angle is defined between the stop member and the tangent line. During the operation of the ratchet wheel, a great ineffective component of force is produced. Further the limited area of bearing force causes the stop member unable to bear a high torsional force. FIGS. 5 and 6 show still another two structures of ratchet wrench according to the prior art. Due to the limitation of the angular position of the stop member, a great ineffective component of force is produced during the operation of these ratchet wheels. In FIG. 5, a steel ball is provided to stop the ratchet wheel. This design can not bear much torsional force. In FIG. 6, a great ineffective component of force is produced during the operation of the ratchet wrench, causing the ratchet wheel to be deformed easily. FIG. 7 shows still another structure of ratchet wrench according to the prior art. According to this design, the stop member is disposed in a horizontal position, which bears less torsional force, and tends to produce a great reactive force to the ratchet wheel, causing the ratchet wheel to be deformed permanently. The drawbacks of the aforesaid prior art ratchet wheels are produced due to improper angular position design of the stop member relative to the ratchet wheel.

The present invention has been accomplished to provide a ratchet wheel, which eliminates the aforesaid drawbacks. According to the present invention, the side hole in which the stop member is installed and forced by a spring member into engagement with the ratchet wheel in the box in one end of the wrench body defines with the horizontal line which passes through the center of the box a contained angle at about 8~18°. This design greatly reduces the angle of action between the stop member and the ratchet wheel during the operation of the ratchet wrench, so that the inactive component of force can be minimized.

DETAILED DESCRIPTION OF THE PREFERRED EMBODIMENT

Figure 3:
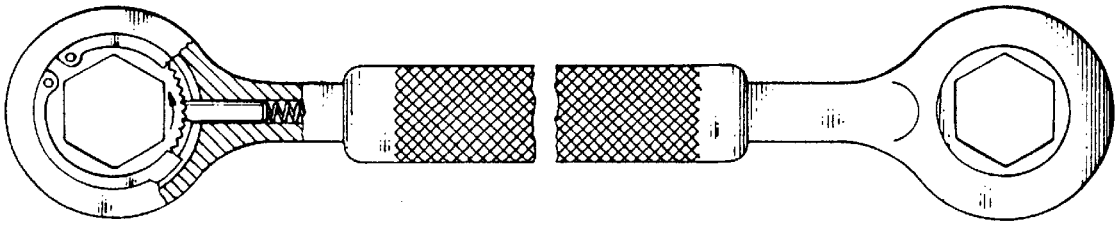
Fig. 3 PRIOR ART
FIG. 3 is a plain view of still another structure of ratchet wrench according to the prior art.
Figure 1:
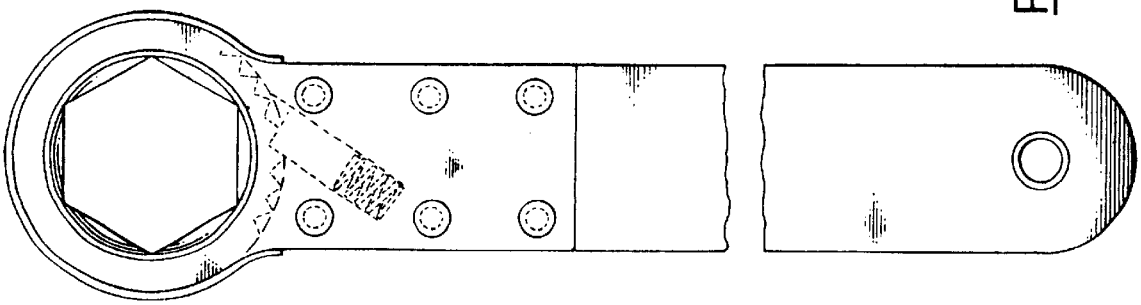
Fig. 1 PRIOR ART
FIG. 1 is a plain view of a ratchet wrench according to the prior art.
Figure 4:
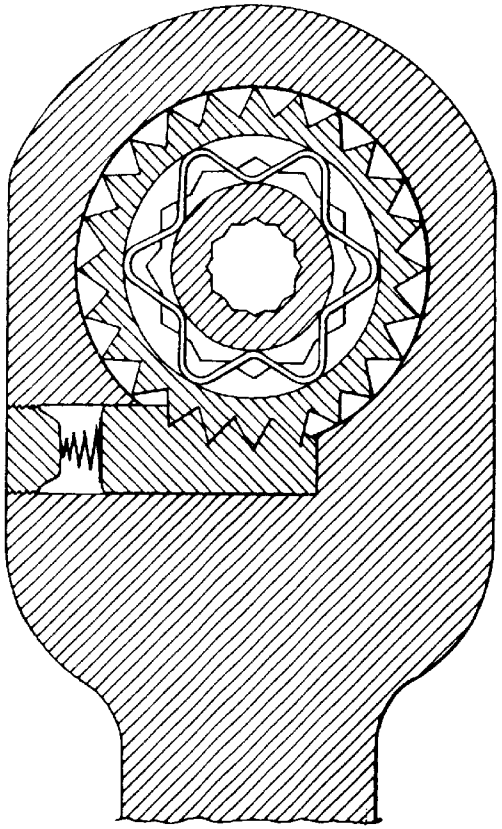
Fig. 4 PRIOR ART
FIG. 4 is a plain view of still another structure of ratchet wrench according to the prior art.
Figure 2:
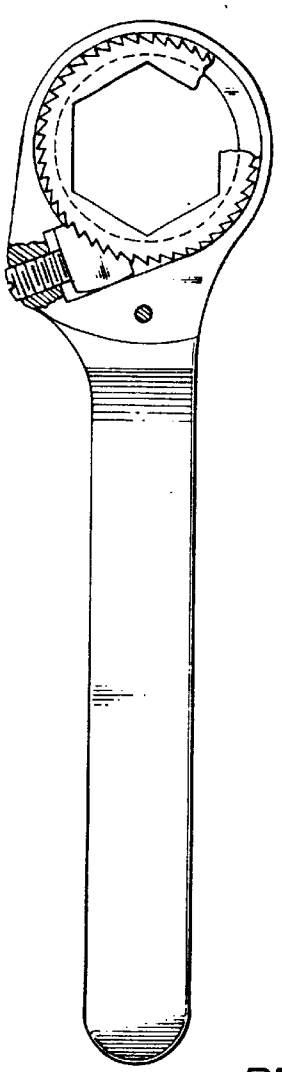
Fig. 2 PRIOR ART
FIG. 2 is a plain view of another structure of ratchet wrench according to the prior art.
Figure 5:
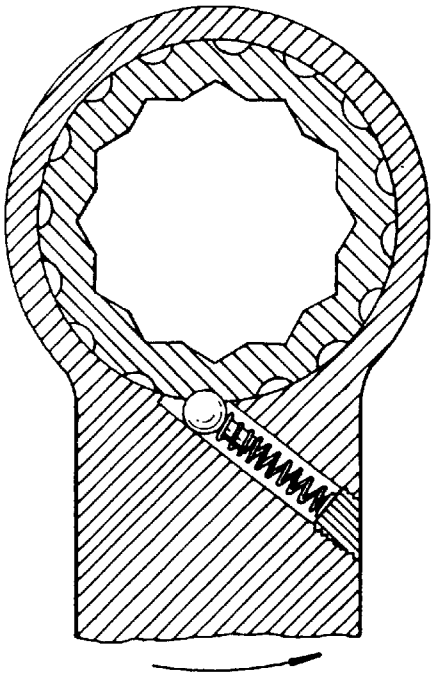
Fig. 5 PRIOR ART
FIG. 5 is a plain view of still another structure of ratchet wrench according to the prior art.
Figure 6:
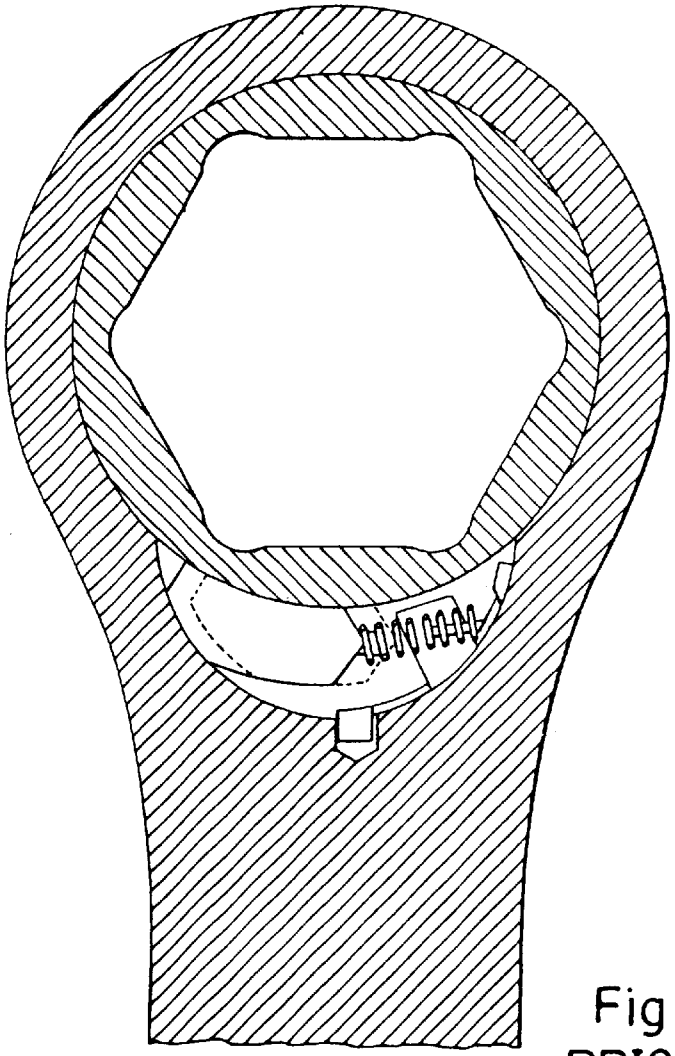
Fig. 6 PRIOR ART
FIG. 6 is a plain view of still another structure of ratchet wrench according to the prior art.
Figure 7:
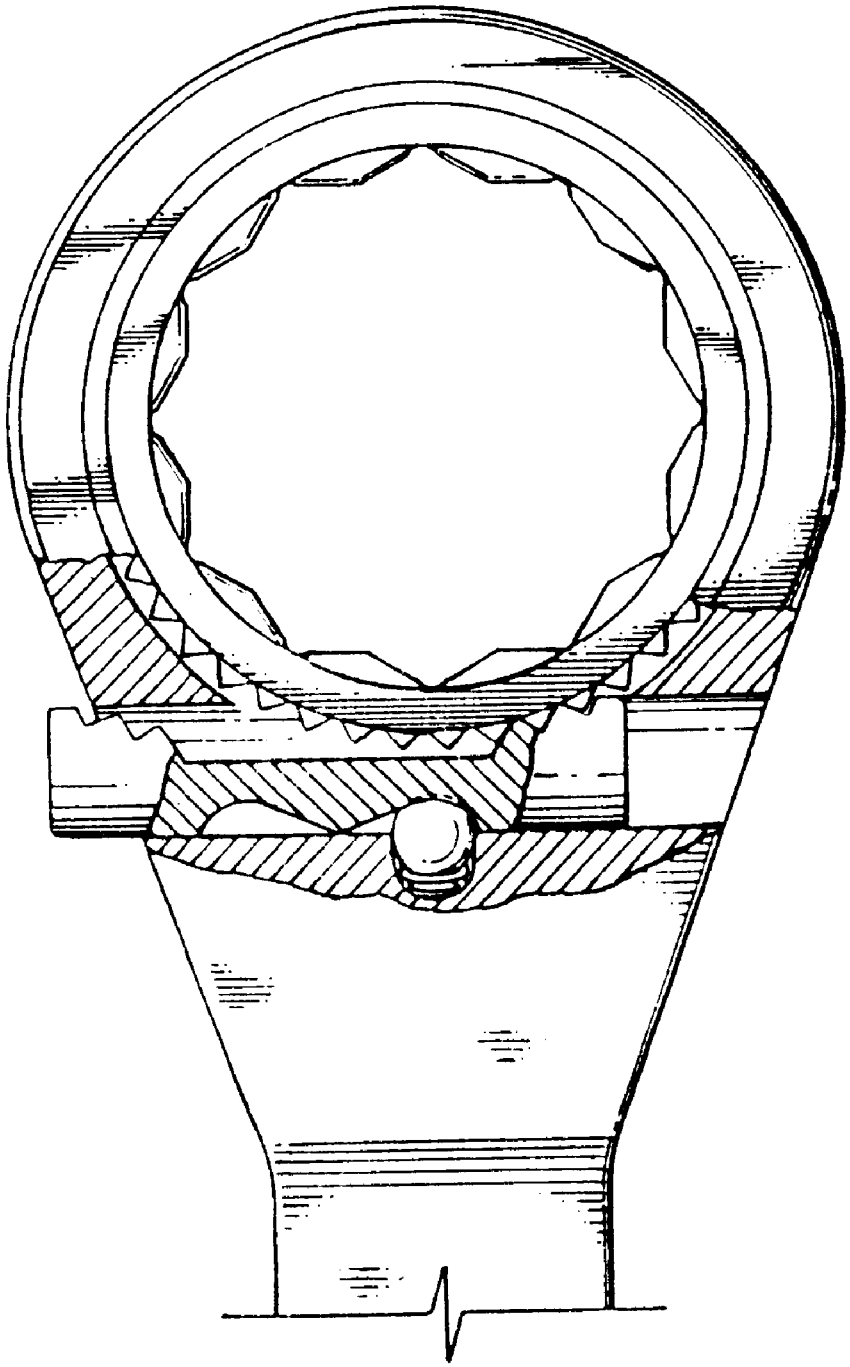
Fig. 7 PRIOR ART
FIG. 7 is a plain view of still another structure of ratchet wrench according to the prior art.
Figure 8:
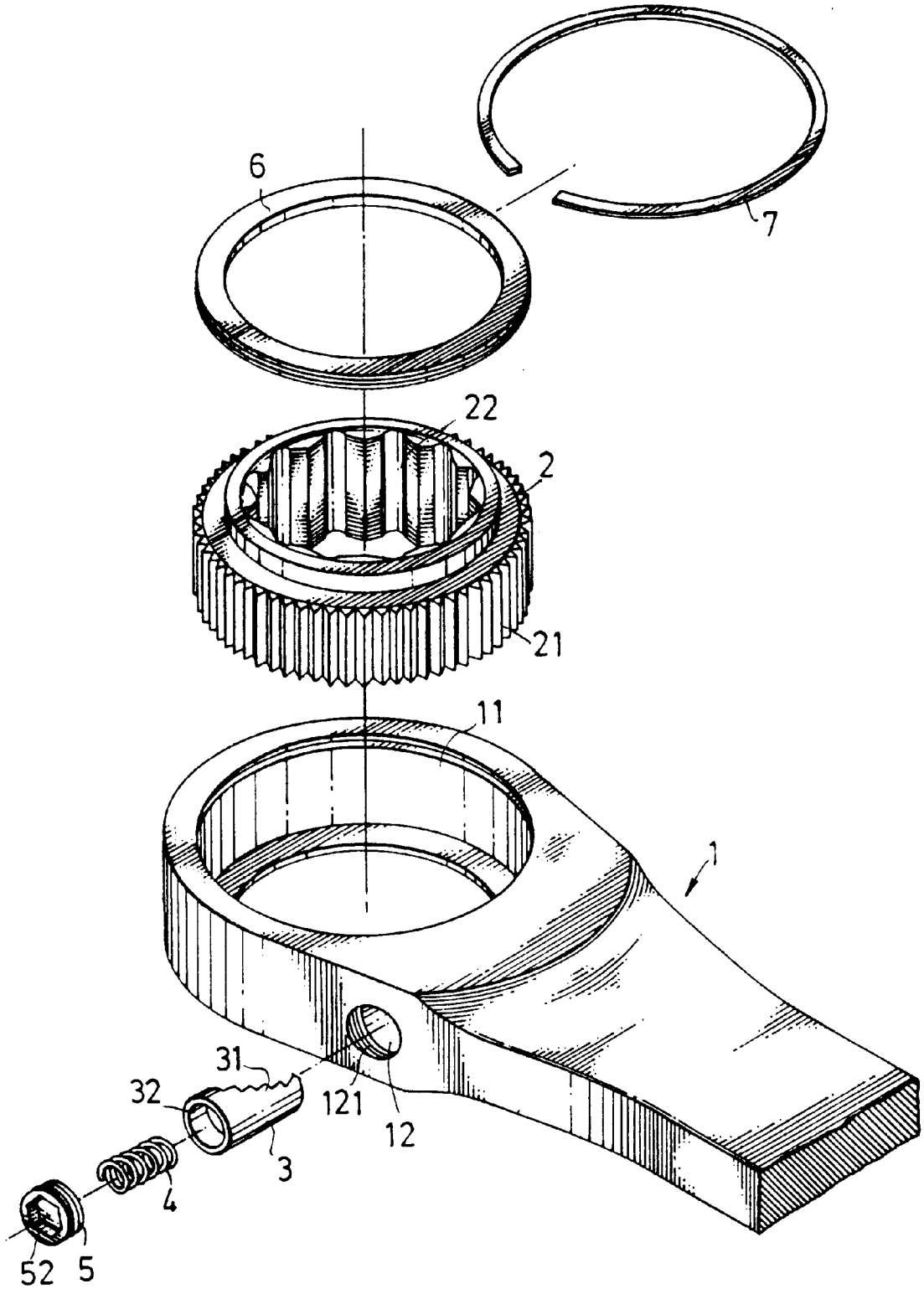
FIG. 8 is an exploded view of a ratchet wrench according to the present invention.

Referring to FIG. 8, a ratchet wrench in accordance with the present invention is generally comprised of a body 1, a ratchet wheel 2, a stop member 3, a spring 4, a screw cap 5, an annular cover plate 6, and a C-shaped retianer 7.

Figure 9:
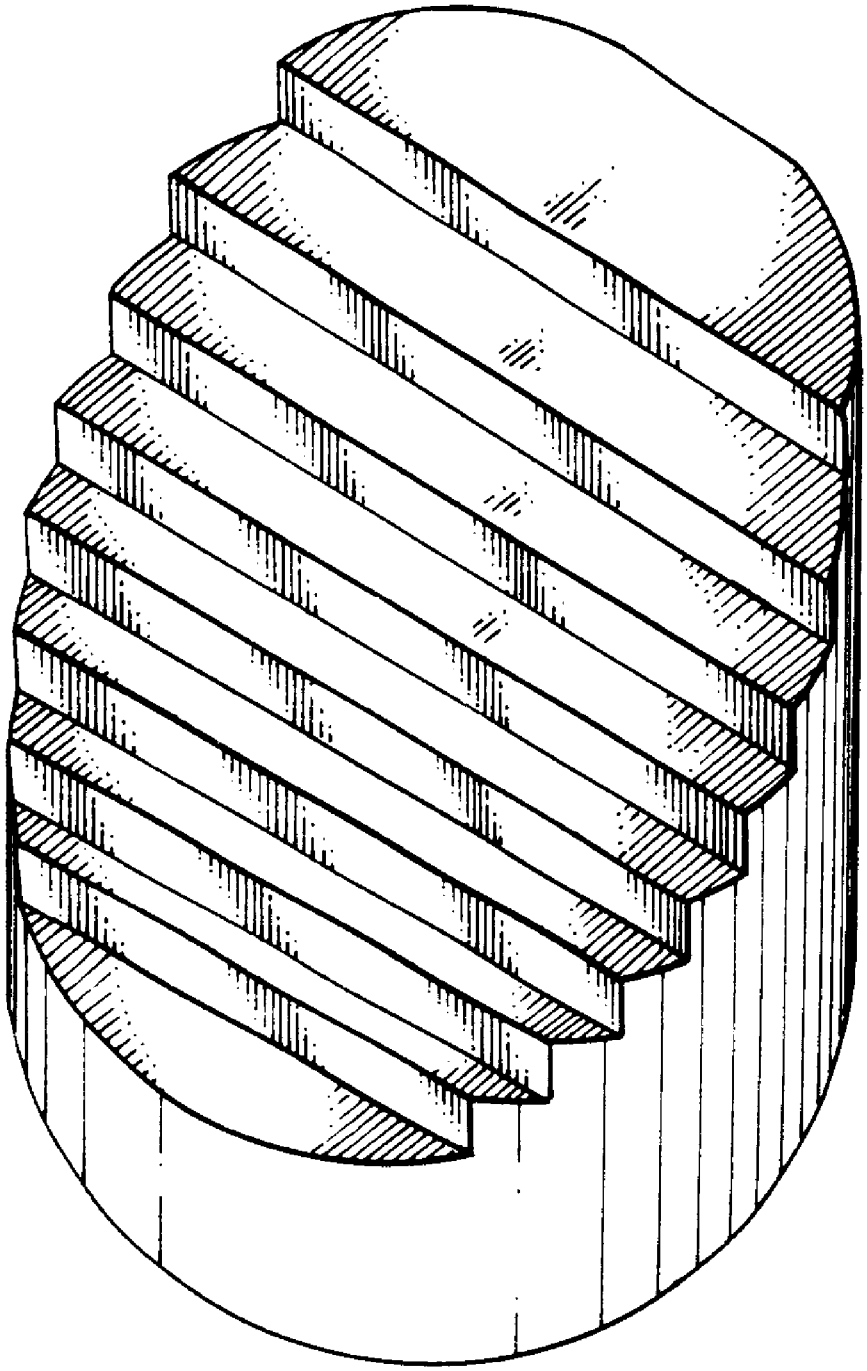
FIG. 9 illustrates the design of the toothed portion of the stop member according to the present invention.
Figure 10:
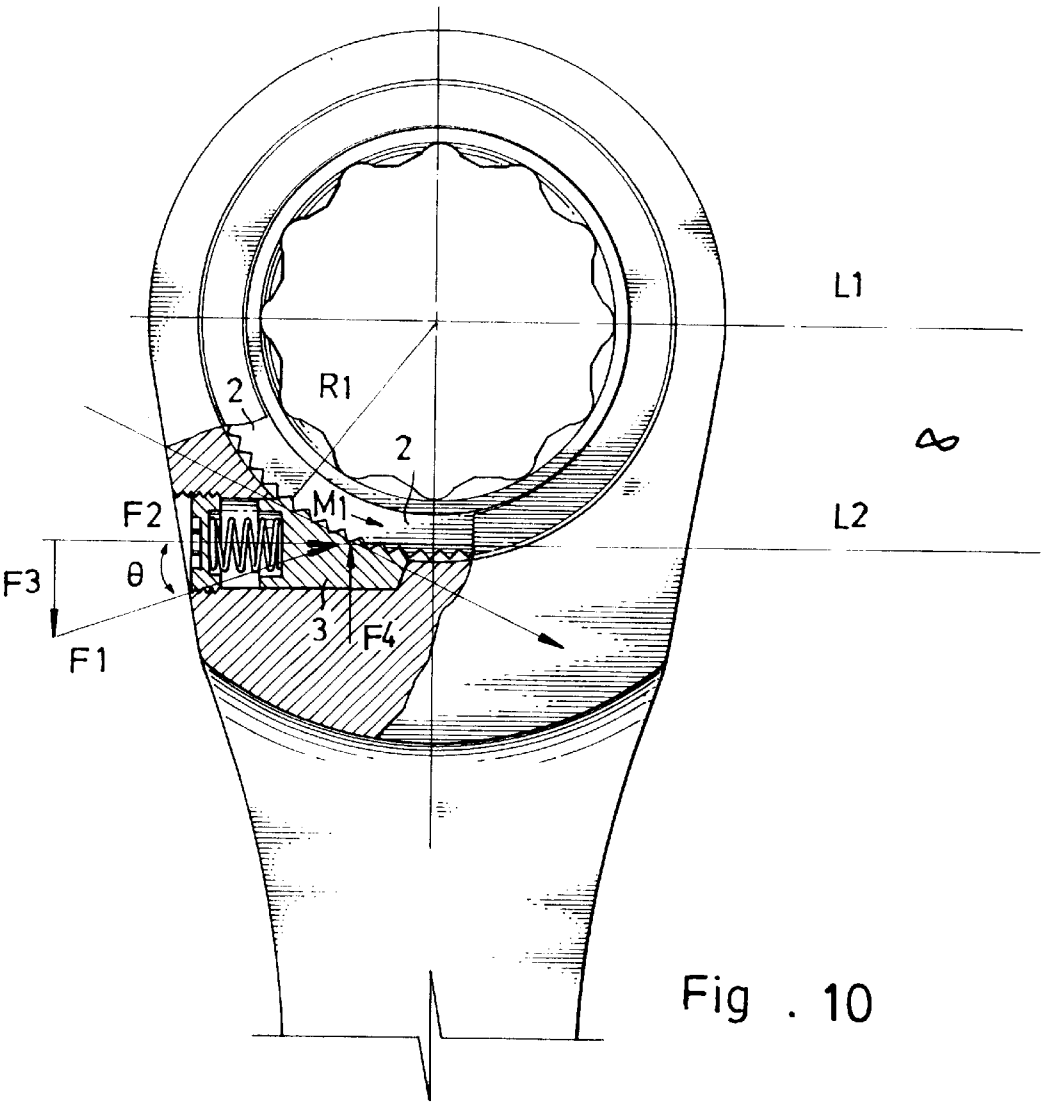
FIG. 10 is a schematic drawing explaining the base component of force according to the present invention.

Referring to FIGS. 9 and 10 and FIG. 8 again, the body 1 has a box 11 in one end thereof, a transverse side hole 12 tangent to the box 11, and an internal thread 121 in the transverse side hole 12 near the outer side. The ratchet 2 is an annular wheel mounted within the box 11, having transverse teeth 21 equiangularly spaced around the periphery thereof and points 22 equiangularly spaced around the inner diameter thereof. The annular cover plate 6 is mounted in the box 11 and secured in place by the C-shaped retainer 7 to hold the ratchet wheel 2 in the box 11. The stop member 3 is a wedge-like metal block mounted within the transverse side hole 12, having a toothed portion 31 meshed with the teeth 21 of the ratchet 2 and a recessed near end hole 32. The spring 4 is mounted in the transverse side hole 12 in the body 1, having one end inserted into the recessed rear end hole 32 on the stop member 3. The screw cap 5 is threaded into the internal thread 121 in the transverse side hole 12 to hold the spring 4 against the stop member 3, having recessed end hole 51 on the front end thereof, which receives one end of the spring 4, and a hexagonal tool slot 52 on the rear end thereof for enabling the screw cap 5 to be turned in and out of the transverse side hole 12 with a tool.

Referring to FIGS. 8 and 9 again, the toothed portion 31 has an oval profile, smoothly curvedly sloping in one direction. After installtion in the transverse side hole 12, the longitudinal central axis of the transverse side hole 12 defines with the horizontal line which passes through the cetner of the box 11 a contained angle at about 8~18°, so that a small angle of action θ is produced after engagement between the toothed portion 31 of the stop member 3 and the teeth 21 of the ratchet wheel 2. This arrangement greatly reduces ineffective componenet of force, and relatively increases effective component of force.

Figure 11:
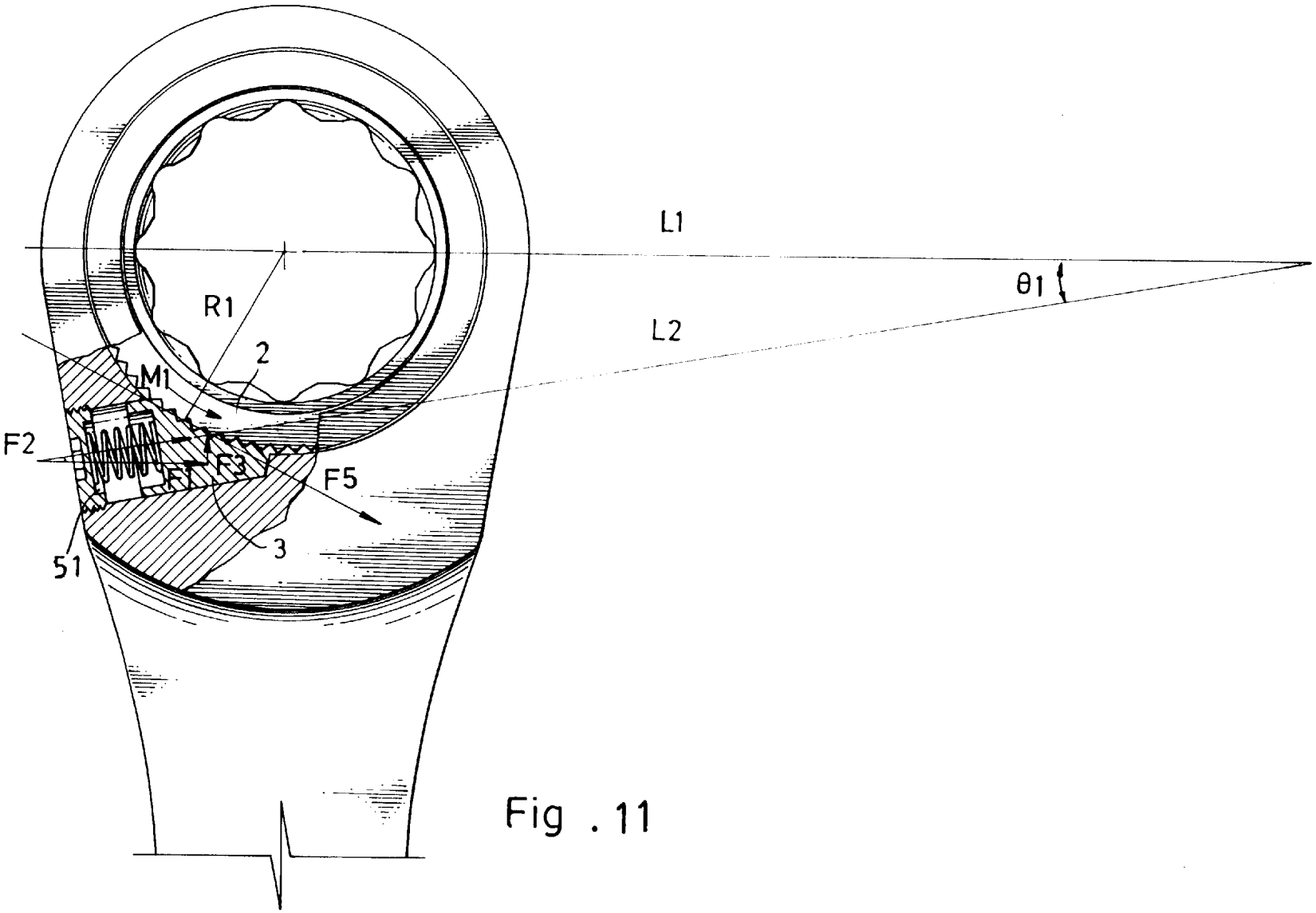
FIG. 11 is a schematic drawing explaining different components of force according to the present invention.

Referring to FIG. 11 and FIG. 10 again, after instalition of the stop member 3 in the transverse side hole 12, the stop member 3 is disposed in parallel to line (the longitudinal central axis of the transverse side hole 12) L12. When L1∞L2, the ratchet wheel 2 receives a driving power M1, where M1=F5*R1, and is forced by the driving power M1 to drive the stop member 3. Therefore, a balanced condition occurs only when F2=F5. Due to the direction of force F2, two components of force F3 and F1 are produced, where $F1^2+F2^2+F3^2-2F1*F3 \cos \theta$. When $\theta=0°$ and $\cos \theta=1$, $$F1^2 = F2^2+F3^2-2F1*F3$$

$$F3=0F1\alpha F2$$

When $\theta>0°$ and $\cos \theta<1$, F1<F2, therefore the component of force F3 (ineffective component of force) is relatively reduced, and the component of force F2 (effective component of force) is relatively increased. Because F5=F2, M1=F5*R1, the maximum torsional force is obtained.

As indicated above, if the angle of action $\theta$ is excessively great, the component of force (ineffective component of force) F3 is released incresed, resulting in a lower wrenching efficiency, and simultaneously causing the ratchet wheel 2 to produce a reactive force F4. The reactive force F4 tends to damage the ratchet wheel 2.

Figure 12:
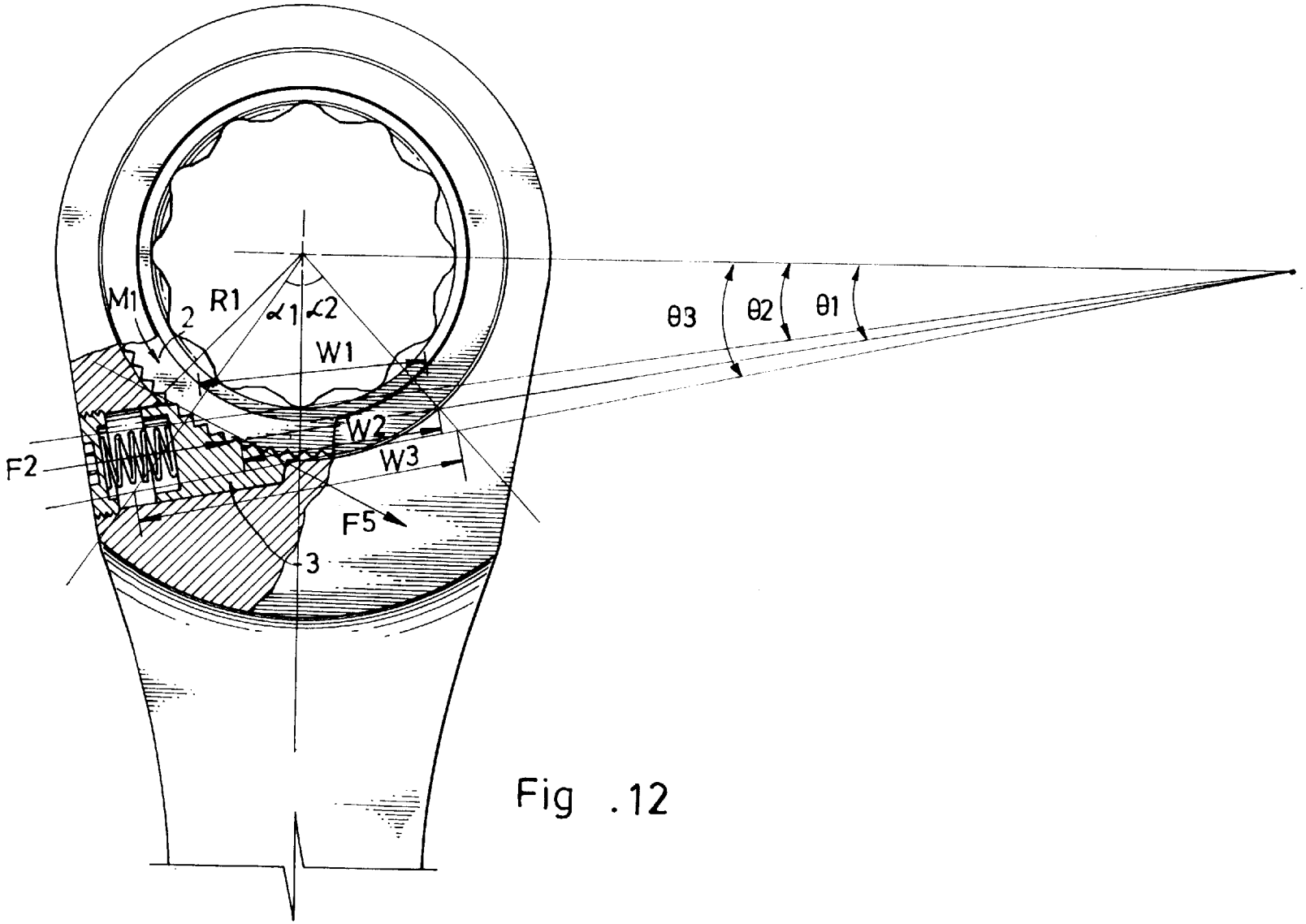
FIG. 12 is a schemtic drawing explaining the best component for force according to the present invention.

Referring to FIGS. 12 and 11 again, when $0<\theta<90°$, thus $0<\cos \theta<1F3\alpha1/F2$ when L1 and L2 define a contained angle $\theta1$, and $\theta1$ is designed equal to $\theta$, thus F1=F2, and the applied force is equal to the bearing force without producing a force of interference (ineffective component of force F3). Therefore, the maximum torsional force is obtained without reactive force F4 when the force against thrust F3=0 and $F1\alpha F2$. Further because $\theta1=\theta,\theta1$ is at the tangent line, the maximum cross sectional area of bearing force is otabined. Because M1=F5*R1, if F5=F2, thus M1=F2*R1, and the maximum torsional force is obtained, and the cross sectional area of the bearing force received by the ratchet wheel is within the range of $\alpha1$ and $\alpha2$, and a different cross sectional area W1, W2 or W3 may be produced. Under the condition of $\theta1$ for W2, $\theta2$ for W2, and $\theta3$ for W3, W2>W1>W3 because $\theta1<\theta2<\theta3$. Assums t is the thickness of the ratchet wheel, thus A1=W1*t, A2=W2*t, A3=W2*t. If A=unit area, thus unit area pressure P is as follows:

$$P1 = \frac{F2}{A1} \qquad P1 = \frac{F2}{A2} \qquad P1 = \frac{F2}{A3}$$

Because A2>A1>A3, thus P2>P1>P3. Therefore, F2 achieves the best direction and angle of bearing foce.

I claim:

1. A ratchet wrench stop member positioning arrangement, comprising a wrench body, said wrench body comprising a box and a transversely extended threaded side hole tangent to said box, a ratchet wheel mounted in said box, an annular cover plate secured to said wrench body by a C-shaped retainer to hold said ratchet wheel in said box, a stop member mounted in said side hole, said stop member having a toothed portion meshed with said ratchet wheel, a screw cap fastened to said side hole, and a spring member mounted in said side hole and connected between said screw cap and said stop member and forcing said stop member into engagement with said ratchet wheel, wherein a longitudinal central axis of said transverse side hole and a horizontal line which passes through a center of said box define a contained angle at about 8~18°.

* * * * *